US006340923B1

(12) United States Patent
Yamanaka et al.

(10) Patent No.: US 6,340,923 B1
(45) Date of Patent: Jan. 22, 2002

(54) HIGH FREQUENCY RELAY

(75) Inventors: Hiroshi Yamanaka, Moriguchi; Toshiyuki Suzuki, Nara; Kazunobu Nakata, Fuwa-gun, all of (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/739,774

(22) Filed: Dec. 20, 2000

(30) Foreign Application Priority Data

Dec. 22, 1999 (JP) ..... 11-363617

(51) Int. Cl.[7] ..... H01H 53/00

(52) U.S. Cl. ..... 335/4; 335/78; 335/83; 335/196; 335/199

(58) Field of Search ..... 335/4, 5, 78–86, 335/196, 199, 202, 278

(56) References Cited

U.S. PATENT DOCUMENTS 5,008,487 A * 4/1991 Shimmyo ..... 174/35 R
5,673,011 A 9/1997 Okihara et al. ..... 335/78
5,994,986 A 11/1999 Takahashi ..... 335/78
6,288,622 B1 * 9/2001 Okihara ..... 335/202

FOREIGN PATENT DOCUMENTS

JP 1-274333 11/1989

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

A high frequency relay comprises a contact base block having pairs of fixed contacts, contact members with movable contacts, and an electromagnet for moving the contact members to open and close the fixed contacts by the movable contacts. The contact base block comprises an injection-molded base having projections on its front surface, first metal films formed as the fixed contacts on top surfaces of the projections, second metal films formed as connection terminals for outside devices on a rear surface of the base, each of which corresponds to one of the first metal films, through holes each having a conductive material on its inner surface to make an electrical connection between one of the first metal films and the corresponding second metal film in the shortest distance, and a third metal film formed on the base to provide electrical isolation from the first and second metal films, which works as electromagnetic shield as well as a ground.

19 Claims, 16 Drawing Sheets

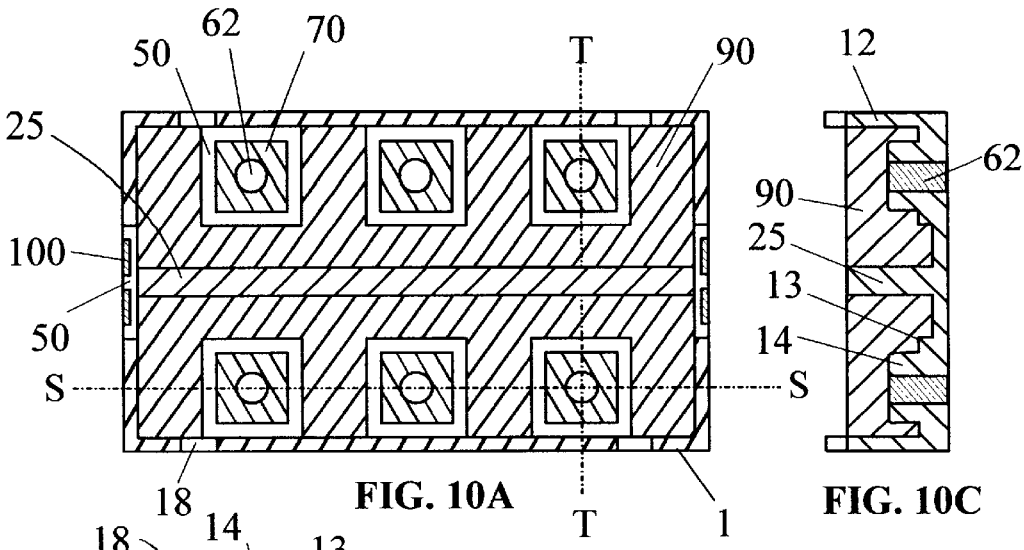
FIG. 10A
FIG. 10C
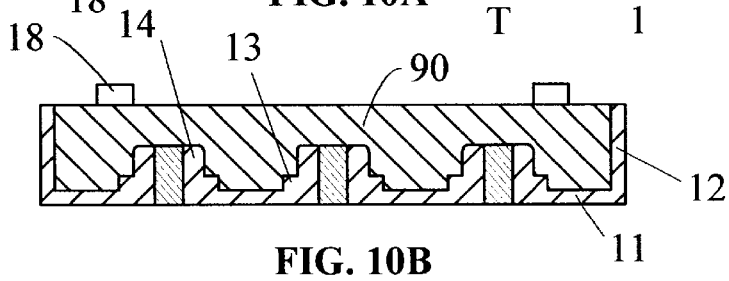
FIG. 10B
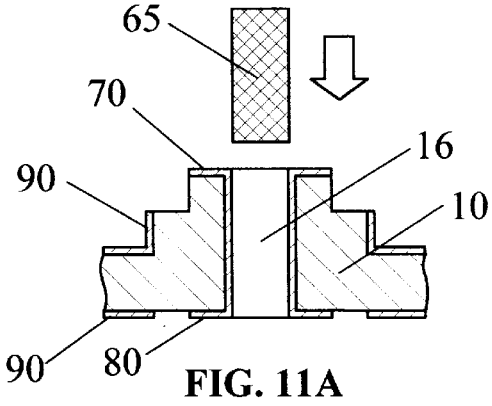
FIG. 11A
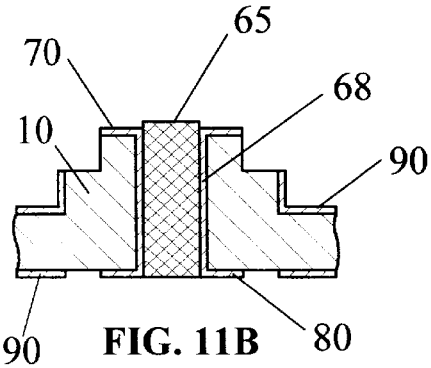
FIG. 11B
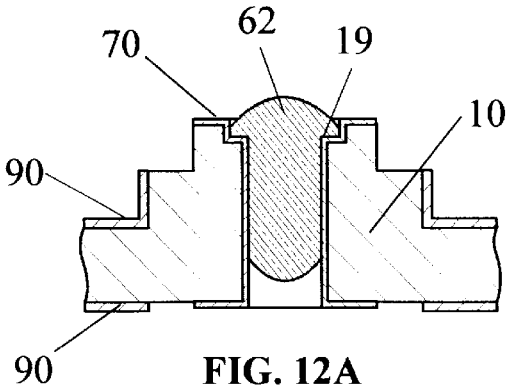
FIG. 12A
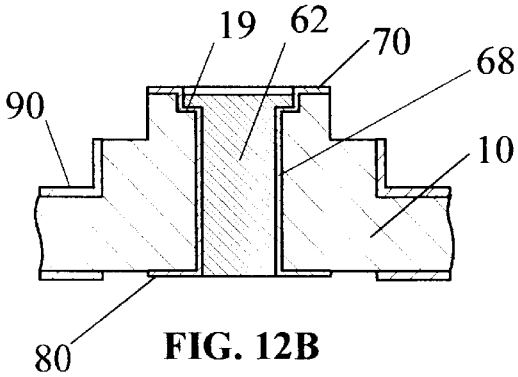
FIG. 12B

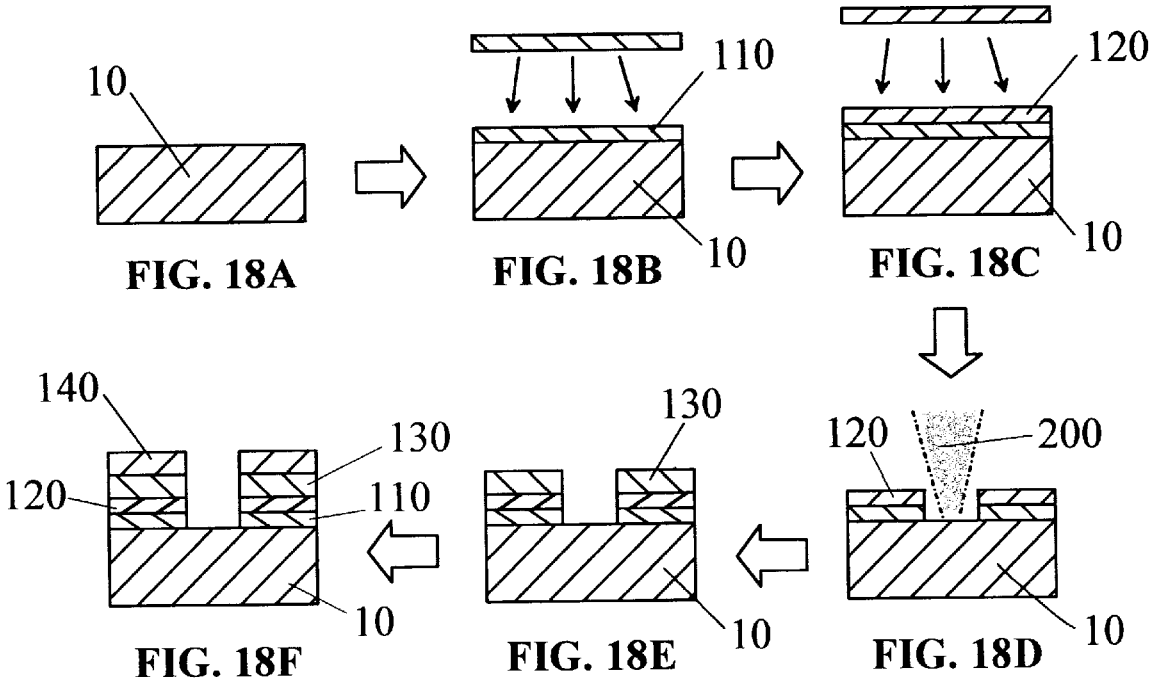
FIG. 18A FIG. 18B FIG. 18C
FIG. 18F FIG. 18E FIG. 18D
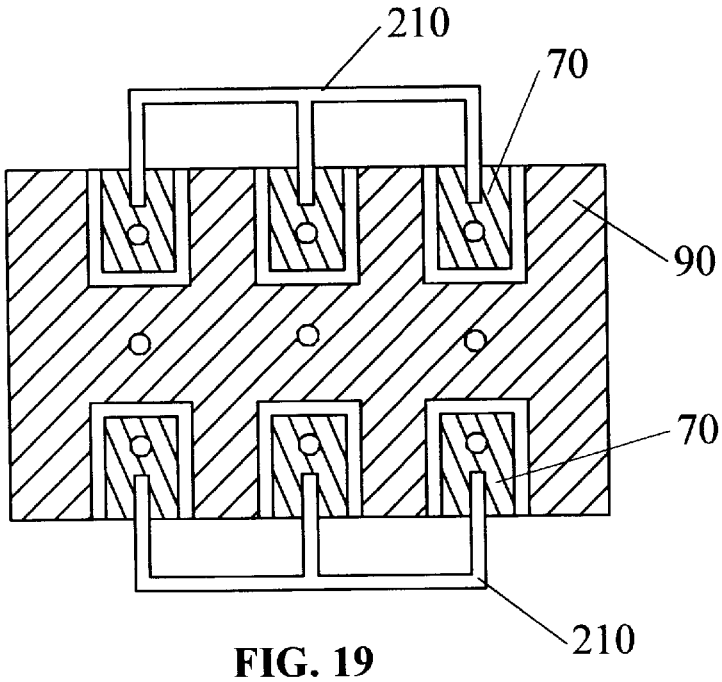
FIG. 19

HIGH FREQUENCY RELAY

BACKGROUND OF THE INVENTION

1. Field of the Invention

The present invention relates to a high frequency relay.

2. Disclosure of the Prior Art

In the past, high frequency relays have been used to switch high frequency signals. For example, Japanese Patent Early Publication [KOKAI] No. 1-274333 discloses that a high frequency relay comprises a base, on which fixed contacts of gold-plated pins are mounted, a card having contact springs, a shield case having earth terminals manufactured by working a sheet metal, an electromagnet for moving the contact springs to open and close a pair of the fixed contacts by the contact spring, and a shield cover.

However, in this kind of high frequency relay, there are problems that variations in high frequency characteristic of the high frequency relay such as such as insertion loss, isolation loss and V.S.W.R. (reflection) occurs due to errors in working and assembling the relay components. On the other hand, when working and assembling the relay components with high accuracy, there is another problem of increasing the production cost of the high frequency relay in a large amount. In particular, as the relay becomes smaller in size, there is a limitation of working and assembling the relay components with high accuracy.

SUMMARY OF THE INVENTION

Therefore, a primary object of the present invention is to provide a high frequency relay capable of improving electromagnetic shield effect for preventing signal leakage and minimizing variations in high frequency characteristic resulting from steps of working and assembly the relay components.

That is, in the high frequency relay comprising a contact base block having at least one pair of fixed contacts, at least one contact member with a movable contact, and an electromagnet for moving the contact member to open and close the pair of fixed contacts by the movable contact, the contact base block comprises a base having at least one pair of projections on its top surface, which is an injection-molded article of an electrical insulating material; first metal films formed as the fixed contacts on top surfaces of the projections; second metal films formed as connection terminals for outside devices on the base, each of which corresponds to one of the first metal films; connecting means for making an electrical connection between each of the first metal films and the corresponding second metal film; and a third metal film at least formed on the top surface of the base to provide electrical isolation from the first and second metal films, which works as electromagnetic shield means.

By the way, to stabilize the high frequency characteristic of the high frequency relay, it is important to keep the assembly accuracy of relay components constant. In particular, it is required to accurately determine a distance between each of the fixed contacts and the corresponding connection terminal. In the past, when the relay components including the fixed contacts and the connection terminals are provided as separate parts, it is required to work and assemble each of the relay components with high accuracy, so that there is another problem of increasing the production cost.

In the present invention, since the first, second and the third metal films, which respectively function as the fixed contacts, connection terminals, and the electromagnetic shield means for preventing the leakage of the high frequency signals, are integrally formed on the injection-molded base, it is possible to readily and accurately control the distance between each of the fixed contacts and the corresponding connection terminal, and sharply reduce the total number of the relay components. According to these advantages, the present invention can stably provide the high frequency relay having a constant high frequency characteristic. In particular, as the high frequency relay becomes smaller in size, the present invention becomes to be more effective. Moreover, since the first metal films that are the fixed contacts are formed on the top surfaces of the projections, the movable contact can open and close the fixed contacts with reliability without contacting the third metal film.

In a preferred embodiment of the present invention, the high frequency relay further comprises a contact sub block for movably supporting the contact member, which comprises a subbase that is an injection-molded article of an electrical insulating material, and a fourth metal film formed on a surface of the subbase in a face to face relation with the top surface of the base when the contact sub block is mounted on the contact base block, so that the pair of fixed contacts are opened and closed by the movable contact in an electromagnetic shield space surrounded by the third and fourth metal films.

It is preferred that each of the second metal films is formed on a bottom surface of the base at a position opposed to the corresponding one of the first metal films. In this case, it is preferred that the connecting means is through holes each having a conductive layer on its inner surface, each of which is formed in the base to electrically connect one of the first metal films with the corresponding second metal film in the shortest distance.

It is further preferred that each of the projections has a first projection jutting from the top surface of the base and a second projection jutting from the first projection, and wherein each of the first metal films is formed on a top of the second projection and the third metal film is formed on side surfaces of the first projections. In addition, it is preferred that each of the projections has a rounded top, on which the first metal film is formed.

In addition, it is preferred that the high frequency relay comprises a first contact set of a first pair of fixed contacts and a first contact member used to switch a high frequency signal and a second contact set of a second pair of fixed contacts and a second contact member used to switch another high frequency signal, and wherein a shield wall for isolating the first contact set from the second contact set is integrally-molded with at least one of the base and the subbase.

In addition, it is preferred that the high frequency relay comprises a coil block for housing the electromagnet comprises an armature disposed between the contact member and the electromagnet and driven by energizing the electromagnet, and a motion of the armature is transferred to the contact member through a first spring member held by a spring holding portion integrally molded with the subbase.

Moreover, it is preferred that a coil block supporting portion for supporting the coil block and the spring holding portion are provided on a surface opposed to the surface having the fourth metal film of the subbase, and the contact member is attached to a through hole formed in the subbase with a second spring member such that the contact member receives a spring bias of the second spring member in a direction of spacing the movable contact from the fixed contacts, and the contact member can be moved against the spring bias of the second spring member by the first spring member pushed by the armature to close the fixed contacts by the movable contact.

It is also preferred that the high frequency relay comprises fifth metal films formed as coil electrodes for supplying electric power to the electromagnet on the base so as to provide electrical isolation from the first, second and third metal films.

Another object of the present invention is to provide a high frequency relay having the following structure. That is, in the high frequency relay comprising a contact base block having at least one pair of fixed contacts, at least one contact member with a movable contact, a contact sub block for movably supporting the contact member, and an electromagnet for moving the contact member to open and close the pair of fixed contacts by the movable contact, the contact base block comprises a base that is an injection-molded article of an electrical insulating material; first metal films formed as the fixed contacts on a top surface of the base; second metal films formed as connection terminals for outside devices on the base, each of which corresponds to one of the first metal films; connecting means for making an electrical connection between each of the first metal films and the corresponding second metal film; and a third metal film at least formed on the top surface of the base to provide electrical isolation from the first and second metal films, which works as electromagnetic shield means. In addition, the contact sub block comprises a subbase that is an injection-molded article of an electrical insulating material, and a fourth metal film formed on a surface of the subbase in a face to face relation with the top surface of the base when the contact sub block is mounted on the contact base block, so that the pair of fixed contacts are opened and closed by the movable contact in an electromagnetic shield space surrounded by the third and fourth metal films.

In the present invention, since the first, second and the third metal films, which respectively function as the fixed contacts, connection terminals, and the electromagnetic shield means for preventing the leakage of the high frequency signals, are integrally formed on the injection-molded base, and the fourth metal film is integrally formed as the electromagnetic shield means on the injection-molded subbase, there is an advantage that the electromagnetic shield space having a remarkable effect of preventing the signal leakage can be stably obtained in the high frequency relay by the third and fourth metal films even when the high frequency relay is small-sized.

These and still other objects and advantages will become apparent from the following detailed description of the invention.

BRIEF DESCRIPTION OF THE DRAWINGS

FIGS. 10A to 10C are a front view, cross-sectional views taken along the lines S and T of a modification of the contact base block;

FIGS. 11A and 11B are schematic cross-sectional views illustrating an insertion of a metal pin into a through hole of the contact base block;

FIGS. 12A and 12B are schematic cross-sectional views illustrating a charge of a sealing compound into a through hole of the contact base block;

FIGS. 18A to 18F are schematic diagrams illustrating a method of manufacturing a contact base block of the high frequency relay according to a preferred embodiment of the present invention;

FIG. 19 is a plan view illustrating electrode members used for electroplating;

DETAILED DESCRIPTION OF THE PREFERRED EMBODIMENTS

A high frequency relay according to a preferred embodiment of the present invention is explained in detail referring to the attached drawings.

Figure 1:
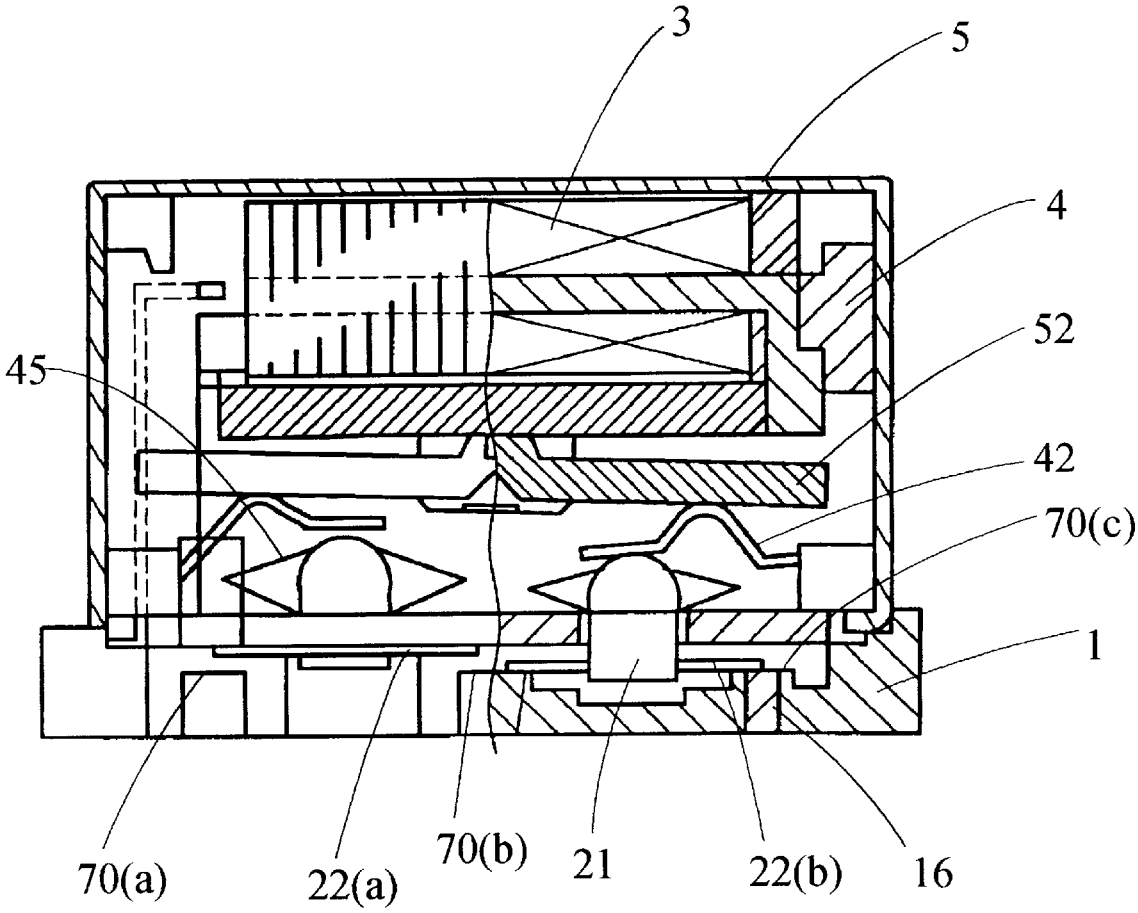
FIG. 1 is a cross-sectional view of a high frequency relay according to a preferred embodiment of the present invention.
Figure 2:
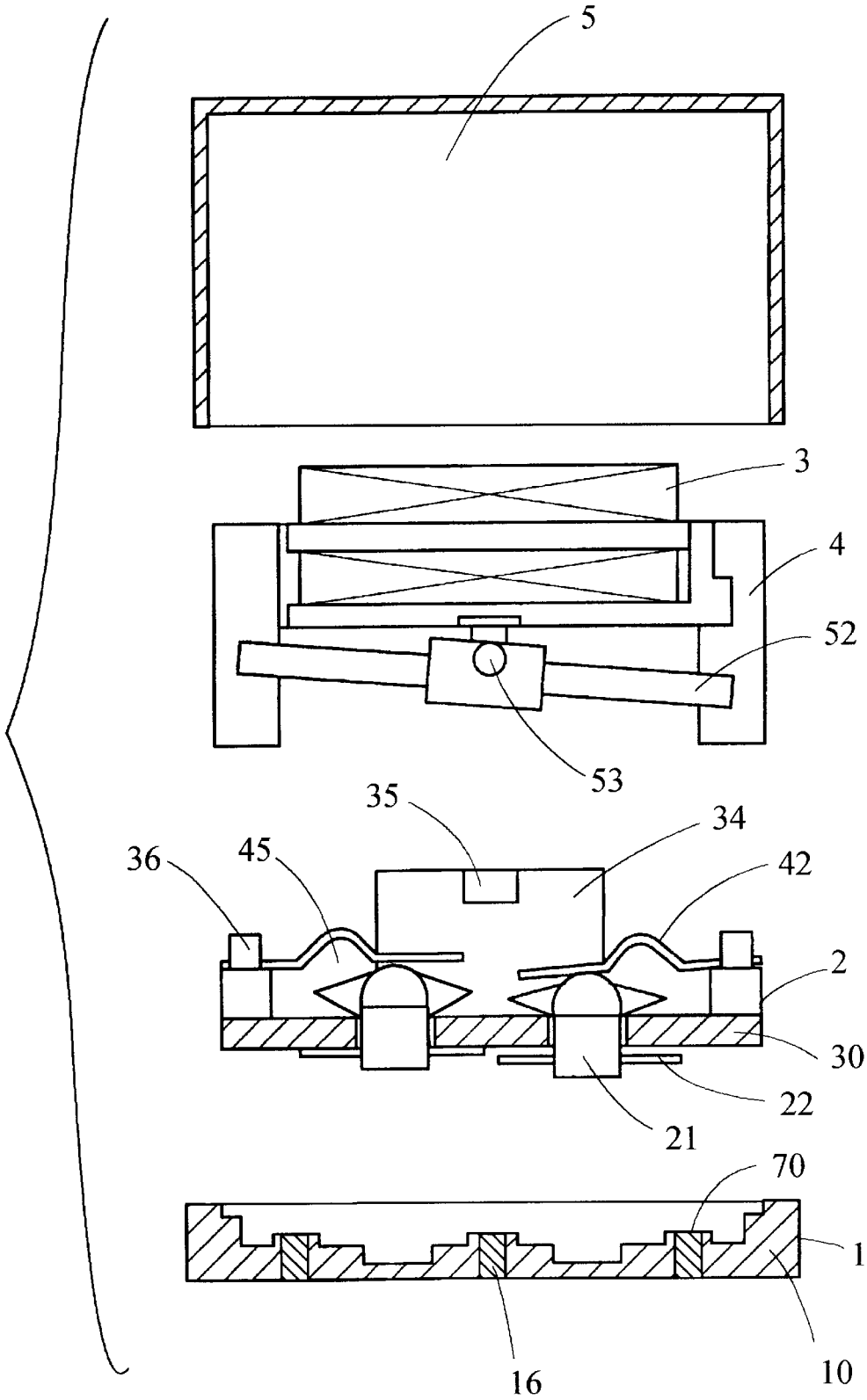
FIG. 2 is an exploded view of the high frequency relay.

As shown in FIGS. 1 and 2, the high frequency relay is mainly composed of a contact base block 1 having plural pairs of fixed contacts, a contact sub block 2 for movably supporting contact members 21 with movable contacts 22, an electromagnet 3 for moving the contact members to open and close the fixed contacts by the movable contacts, coil block 4 for supporting the electromagnet, and a relay case 5.

As shown in FIGS. 3A to 3F and 4A to 4F, the contact base block 1 comprises a base 10, first metal films 70 formed as the fixed contacts on the base, second metal films 80 formed as connection terminals for outside devices on the base, each of which corresponds to one of the first metal films, and a third metal film 90 formed as a part of electromagnetic shield means on the base to provide electrical isolation from the first and second metal films.

The base 10 is an injection-molded article of an electrical insulating material having a rectangular case shape composed of a bottom wall 11, side walls 12 jutting on the periphery of the bottom plate, and a top opening. The base 10 has a plurality of first projections 13 jutting from the bottom wall 11, each of which is of a rectangular shape, and second projections 14 jutting from the top surfaces of the first projections, each of which is of a smaller rectangular shape. Each of the second projections has a through hole 16 extending from the top surface of the second projection to the rear surface of the base 10. In this embodiment, the high frequency relay has a first contact set of the fixed contacts (upper 3 fixed contacts of FIG. 3A) and the contact members used to switch a high frequency signal and a second contact set of the fixed contacts (lower 3 fixed contacts of FIG. 3A) and the contact members used to switch another high frequency signal.

The numeral 17 designates through-holes extending from the front surface to the rear surface of the bottom wall 11 of the base 10. The numeral 18 designates guide projections jutting from the top of side walls 12, which are used to readily and accurately mount the contact sub block on the contact base block. Thus, since the base having the first and second projections 13, 14, through holes 16, 17, and guide projections 18 is formed by injection molding, it is possible to stably supply the base having a constant dimensional accuracy and reduce the number of the relay components. The through holes 16, 17 may be formed by drilling after the injection molding.

Figure 3A:
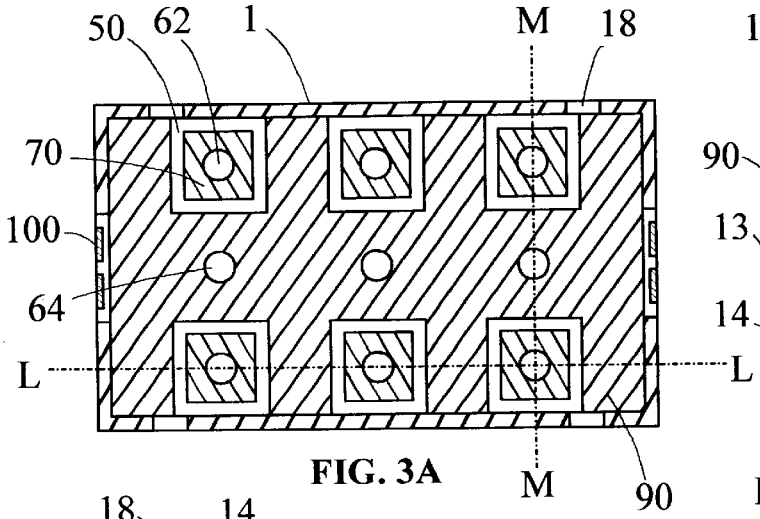
FIGS. 3A to 3F are a front view, cross-sectional view taken along the line L, side view, rear view, cross-sectional view taken along the line M, and a side view of a contact base block of the high frequency relay, respectively.
Figure 3E:
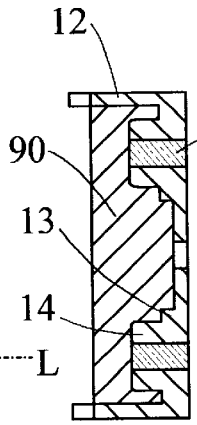
Figure 3F:
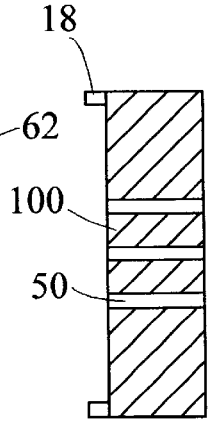
Figure 3B:
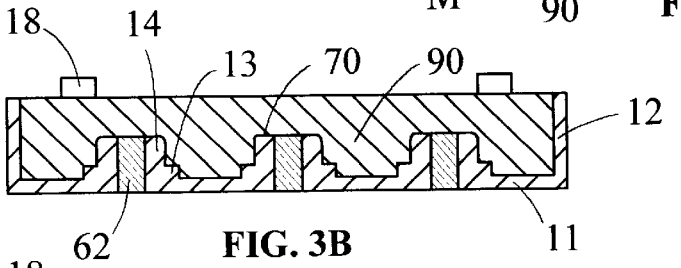
Figure 3C:
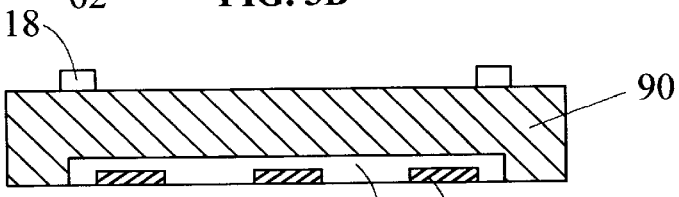
Figure 5A:
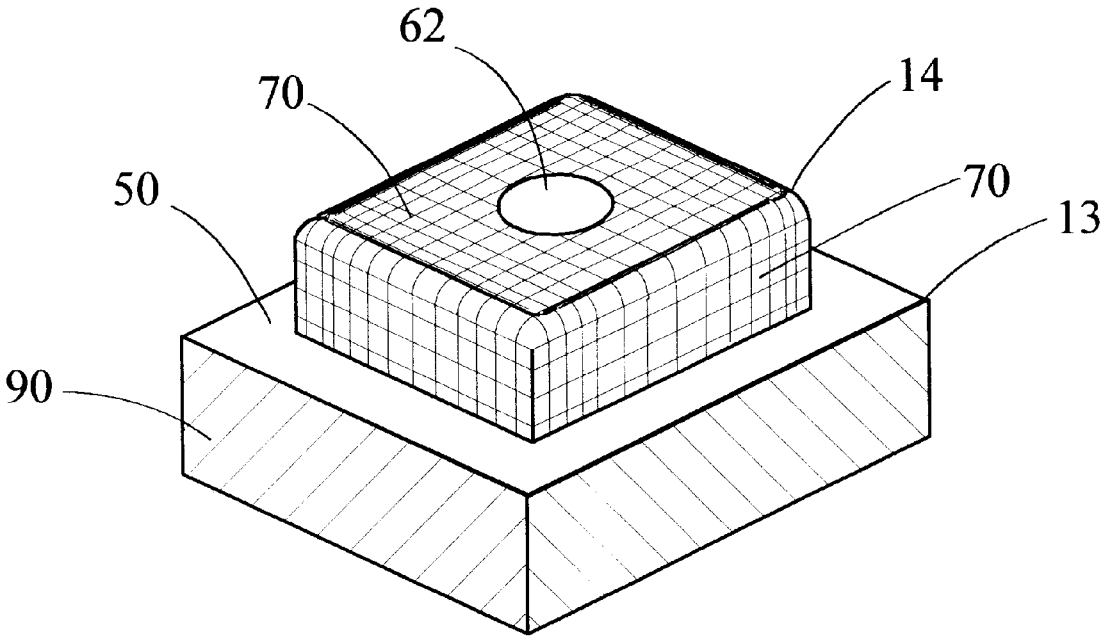
FIG. 5A is a partially perspective view of the contact base block.
Figure 5B:
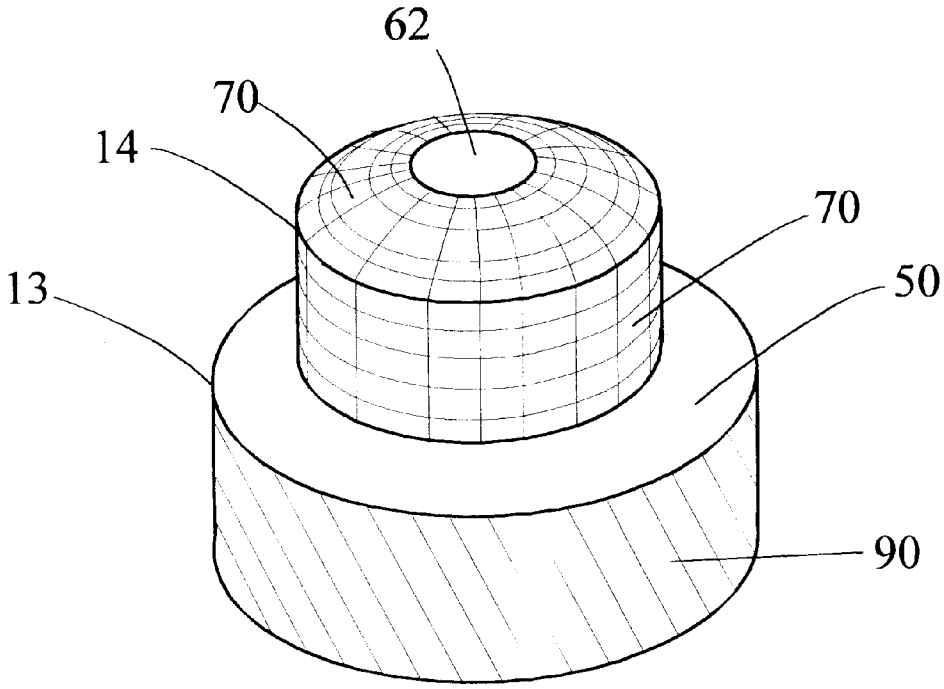
FIG. 5B is a partially perspective view showing a modification of FIG. 5A.
Figure 6A:
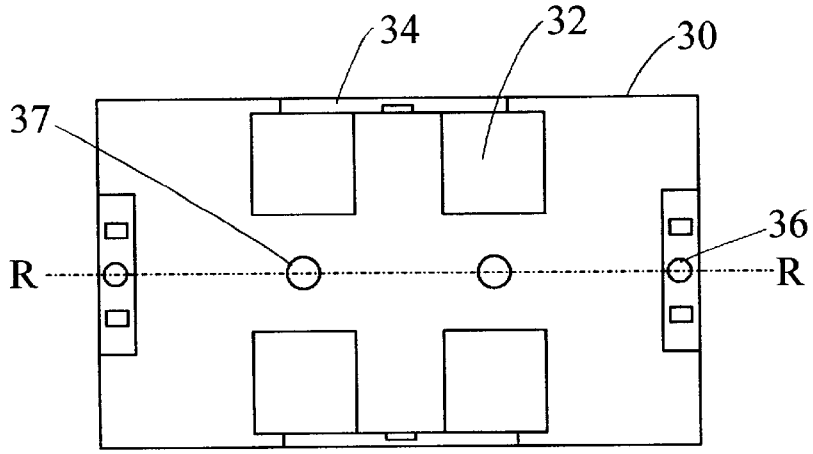
FIGS. 6A to 6E are a front view, cross-sectional view taken along the line R, side view, rear view and a side view of a contact sub block of the high frequency relay, respectively.
Figure 6E:
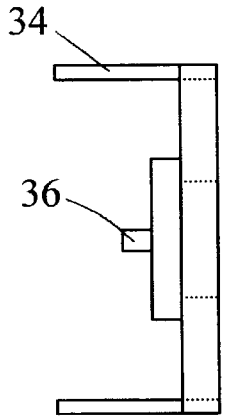
Figure 6B:
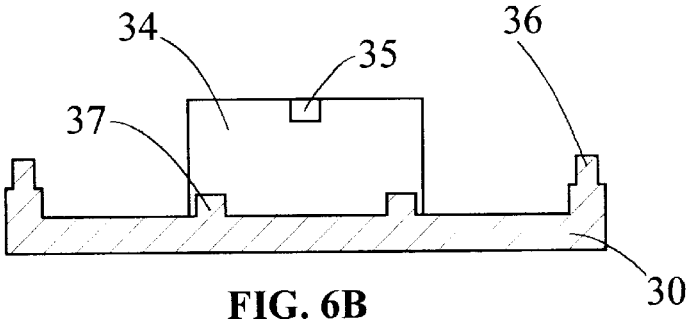
Figure 6C:
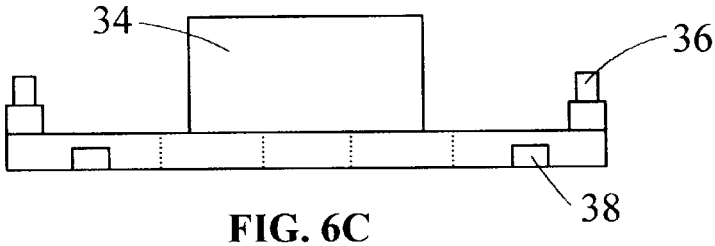
Figure 6D:
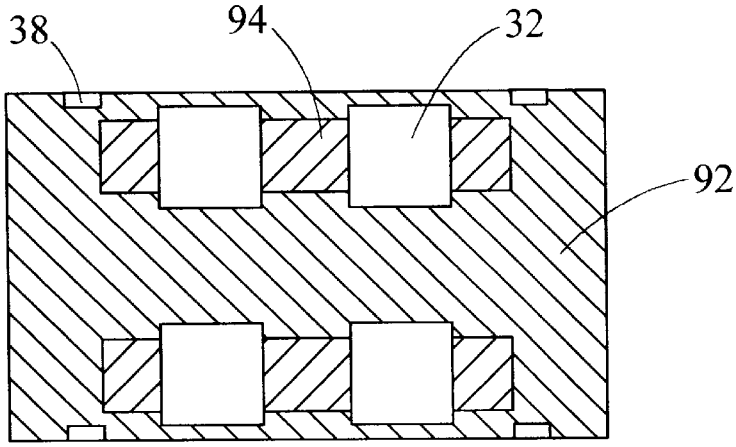

Each of the first metal films 70 is formed on the top and side surfaces of the second projection 14, as shown in FIG. 3A. Since the first metal films 70 that are the fixed contacts are formed on the top surfaces of the second projections 14, the movable contact 22 can open and close the fixed contacts with reliability without contacting the third metal film 90. In this embodiment, the second projection 14 has a rounded rectangular top shown in FIG. 5A to prevent the occurrence of arc discharge between the fixed contacts, i.e., the first metal films 70 and the movable contact 22. Alternatively, as shown in FIG. 5B, a cylindrical projection having a dome-shaped top may be adopted as the second projection 14. In this case, it is preferred that the first and second projections are formed such that a center axis of the first projection 13 is in agreement with that of the second projection 14.

Figure 3D:
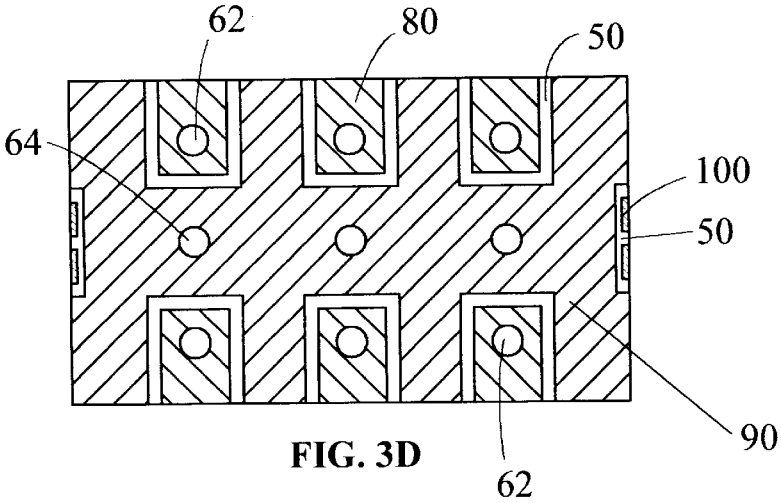
Figure 4A:
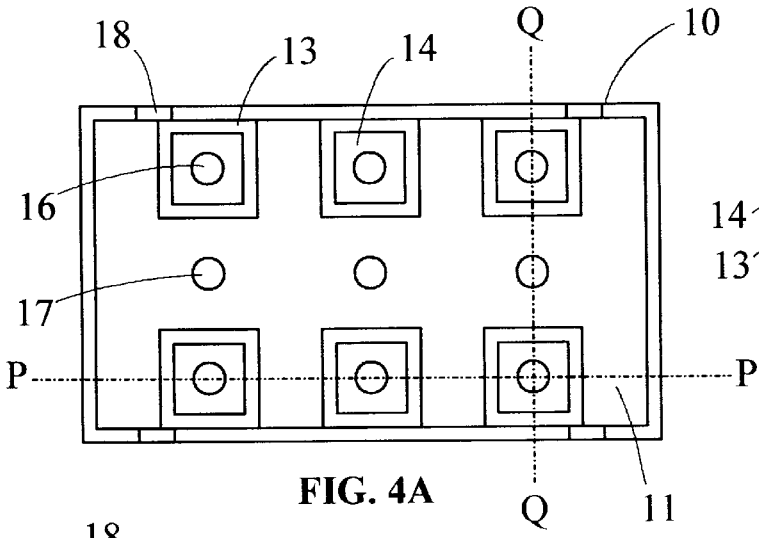
FIGS. 4A to 4F are a front view, a cross-sectional view taken along the line P, side view, rear view, cross-sectional view taken along the line Q, and a side view of an injection-molded base of the contact base block, respectively.
Figure 4E:
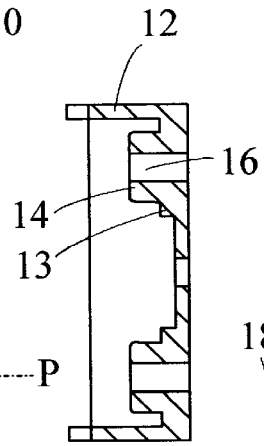
Figure 4F:
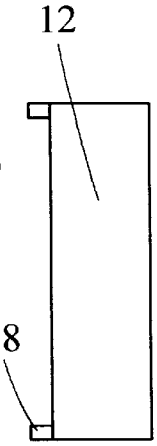
Figure 4B:
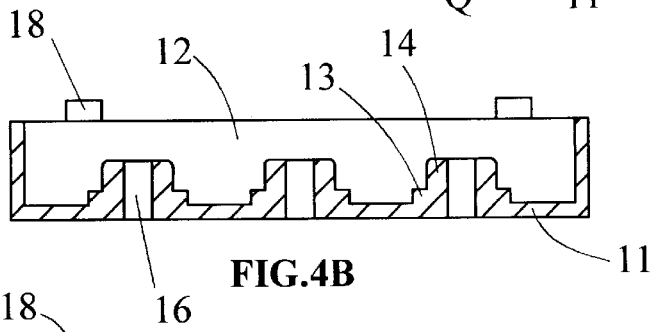
Figure 4C:
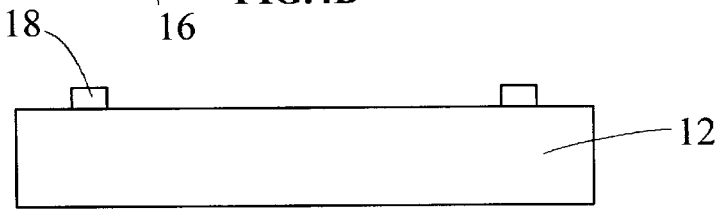
Figure 4D:
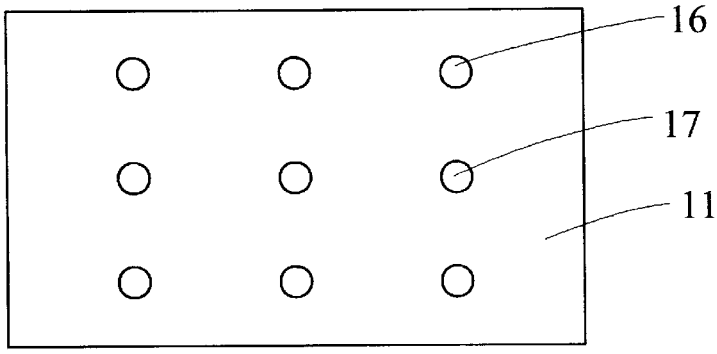

Each of the second metal films 80 is formed on the rear surface of the base 10, as shown in FIG. 3D, at a position opposed to the corresponding one of the first metal films 70. In addition, a part of the second metal film 80 extends to the side wall 12, to which desired outside devices such as printed wiring boards can be readily connected by soldering.

The third metal film 90 is formed the base 10 to extend from the front surface to the rear surface of the bottom wall 11 through the side walls 12. The third metal film 90 is also formed on the side surfaces of the first projection 13, so that the signal leakage can be more effectively prevented when the high frequency signal is transmitted through the through-hole connection between the fixed contact 70 and the corresponding connection terminal 80. To electrically isolating the third metal film 90 from the first and second metal films 70, 80, an isolation area 50 having no metal film is formed around the first and second metal films. That is, each of the first metal films 70 is electrically isolated from the third metal film 90 by the isolation area 50 formed on the top surface of the first projection 13 around the second projection 14.

Each of the first metal films 70 is electrically connected to the corresponding one of the second metal films 80 by a conductive layer plated on the inner surface of the through hole 16 in the shortest distance. Since a signal-flow path is shortened by the through-hole connection, it is effective to improve noise immunity. In this case, it is preferred that a center axis of the through hole 16 is substantially in agreement with that of the fist and second projections 13, 14. In addition, the third metal film 90 on the front surface of the bottom wall 11 is electrically connected to the third metal film on the rear surface of the bottom wall by conductive layers plated on the inner surfaces of the through holes 17 in the shortest distance. Since the electrical connection between the third metal films of the front and rear surfaces of the bottom wall 11 of the base 10 by the through holes 17 in the shortest distance provides the same potential at every position of the third metal film 90, it is effective to further improve the high frequency characteristic of the relay. These through holes 16, 17 are filled with a sealing material 62, 64 such as conductive materials and synthetic resins to prevent the occurrence of condensation therein.

The numeral 100 designates fifth metal films formed on the opposite side walls 12, which are used as coil electrodes for supplying electric power to the electromagnet 3 of the high frequency relay. The fifth metal films 100 are electrically isolated from the third metal film by the isolation area 50. Since an electrical connection between the electromagnet 3 and the coil electrodes 100 formed on the base 10 can be achieved by use of wires and so on, it is useful to provide a further simplification of the assembly task for the high-frequency relay.

By the way, it is preferred that each of the first, second and third metal films 70, 80, 90 is composed of a copper layer as an undercoat, nickel layer as an intermediate layer, and a gold layer as an outer layer. In this case, it is particularly preferred that a thickness of the outer layer of the first metal films is greater than that of the second and third metal films. Alternatively, the second and third metal films may essentially consist of a copper layer as the undercoat, and a nickel layer as the outer layer. By reducing the amount used of gold, it is possible to improve cost performance of the high frequency relay.

As shown in FIG. 2, the contact sub block 2 comprises a subbase 30, the contact members 21 with the movable contacts 22, a fourth metal film 92 formed on a rear surface of the subbase, first spring members 42 for transferring a motion of an armature 52 driven by energizing the electromagnet 3 to the contact members 21, and second spring members 45 each applying a spring bias to the contact member in a direction of spacing the movable contact 22 from the fixed contacts 70.

As shown in FIGS. 6A to 6E, the subbase 30 is an injection-molded article of an electrical insulating material, and has four rectangular through holes 32, a pair of side walls 34 projecting from its front surface of the subbase and having bearing portions 35 for movably supporting the armature 52 in a seesaw fashion, spring holders 36 projecting from the front surface of the subbase, each of which is used to catch one end of the first spring member 42, and stoppers 37 projecting from the front surface of the subbase between adjacent rectangular through-holes 32, each of which restricts an excessive motion of the first spring member. The numeral 38 designates concaves formed in a rear surface of the subbase, into which the guide projections 18 are fitted when the contact sub block 2 is mounted on the contact base block 1.

The fourth metal film 92 on the subbase 30 makes an electromagnetic shield space in cooperation with the third metal film 90 of the contact base block 1. In this electromagnetic shield space, each of the pairs of fixed contacts 70 is opened and closed by the corresponding movable contact 22. The formation of the electromagnetic shield space presents a remarkable effect of preventing the leakage of high frequency signal to the outside as well as an improvement in noise immunity. In this embodiment, when the pair of fixed contacts 70 is opened by the movable contact 22, the movable contact comes into contact with a required region 94 of the fourth metal film 92. The required region 94 of the fourth metal film 92 is composed of a copper layer as an undercoat, nickel layer as an intermediate layer and a gold layer as an outer layer. The remainder of the fourth metal film 92 other than the required region 94 is composed of a copper layer as the undercoat and a nickel layer as the outer layer.

Figure 7A:
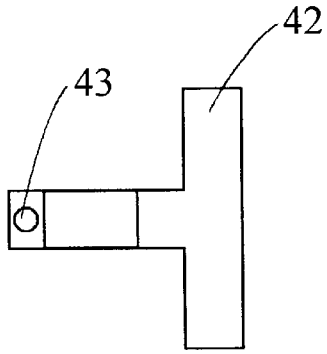
FIG. 7A is a top view of a first spring member.
Figure 7B:
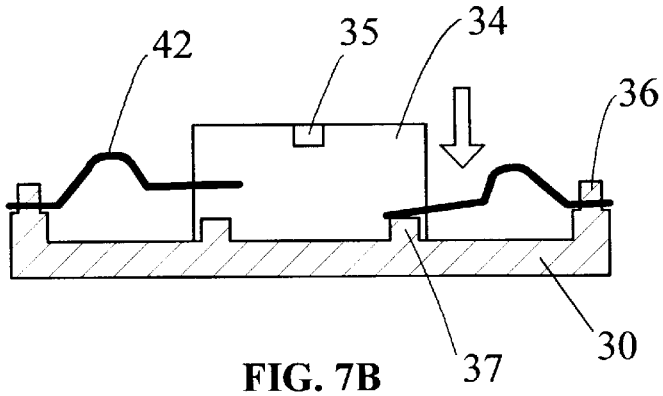
FIG. 7B is a cross-sectional view of a subbase with the first spring members.

The first spring member 42 is of a T-shaped spring having an attachment hole 43 at one end, as shown in FIG. 7A. To fix the first spring member 42 to the subbase 30, the spring holder 36 is inserted into the attachment hole 43 of the first spring member, as shown in FIG. 7B. By use of this spring holder 36 integrally formed with the subbase 30, it is possible to readily mount the first spring member 42 at a required position on the subbase with accuracy. Since the stopper 37 restricts the excessive motion of the first spring member 42, it is possible to prevent the occurrence of abnormal contact pressure between the movable contact 22 and the fixed contacts 70.

Figure 8A:
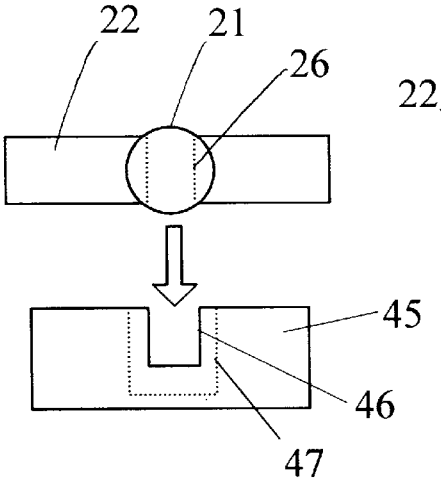
FIG. 8A is a schematic view illustrating how to attach a contact member to a second spring member.
Figure 8B:
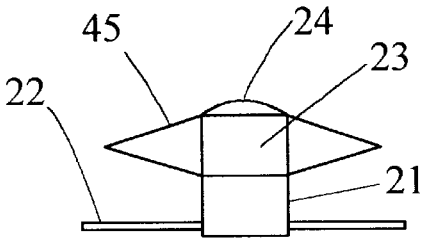
FIGS. 8B to 8D are a front view, back view and a side view of the assembly of the contact member and the second spring member, respectively.
Figure 8D:
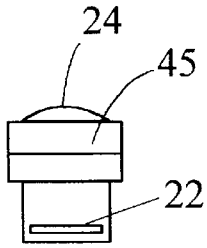
Figure 8C:
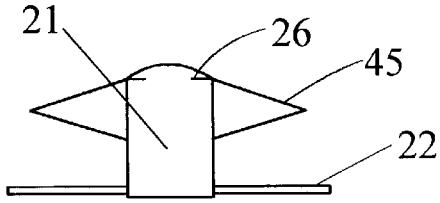

As shown in FIGS. 8A to 8D, the contact member 21 is composed of a cylindrical body 23 having a dome-shaped top 24 and the movable contact 22 of a metal plate projecting from the side face of the cylindrical body in the opposite two directions. The second spring member 45 is of a rhombus shape having a first notch 46 for receiving the dome-shaped top and a second notch 47 for receiving the cylindrical body 23 of the contact member 21. As shown in FIG. 8A, the contact member 21 and the second spring member 45 are assembled by inserting the contact member into the first and second notches 46, 47. The contact member 21 has incisions 26 in the dome-shaped top, to which the first notch 46 of the second spring member 45 is fitted, as shown in FIG. 8C.

The assembly of the contact member 21 and the second spring member 45 is attached to the rectangular through-hole 32 of the subbase 30 such that the contact member receives the spring bias of the second spring member in the direction of spacing the movable contact 22 from the fixed contacts 70 when the contact sub block 2 is mounted on the contact base block 1, as shown in FIG. 1. When the first spring member 42 is pushed down by the armature 52, the contact member 21 is moved against the spring bias of the second spring member 45 to close the fixed contacts 70 by the movable contact 22. On the contrary, when the armature is released from the motion of the armature 52, the contact member 21 is pushed upward by the spring bias of the second spring member 45 to leave the movable contact 22 from the fixed contacts 70. At this time, as described above, the movable contact 22 comes into contact with the required region 94 of the fourth metal film 92.

Figure 9A:
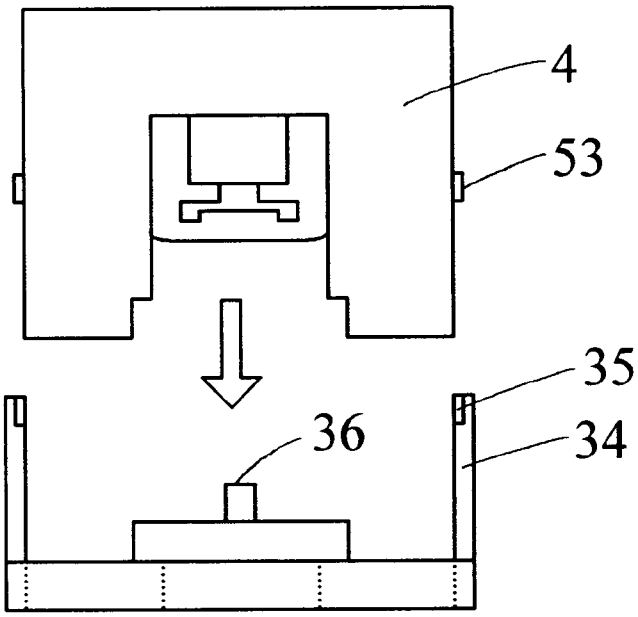
FIGS. 9A and 9B are side views illustrating how to attach a coil block to the contact sub block, respectively.
Figure 9B:
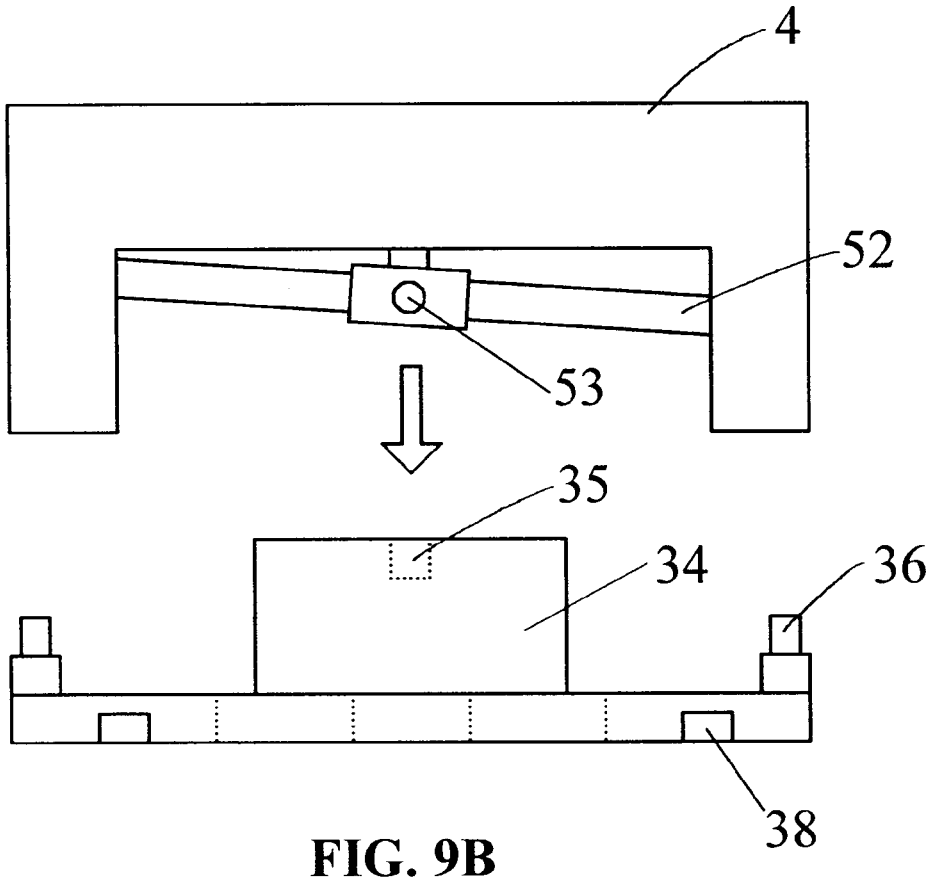
Figure 13A:
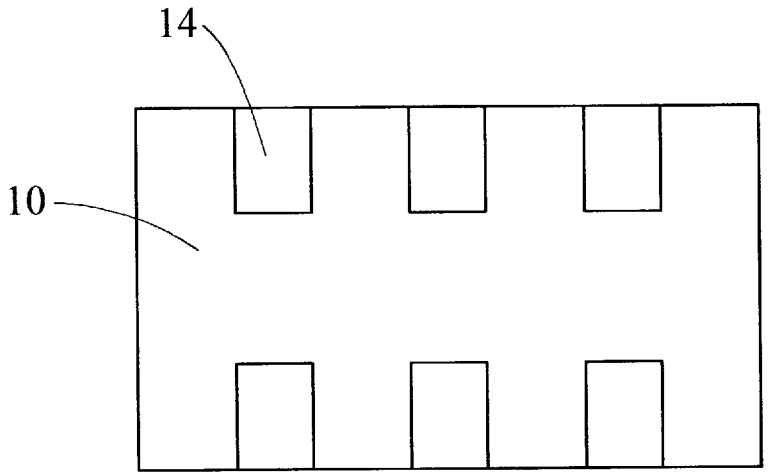
FIGS. 13A to 13D are a front view, side view, rear view and a side view of an injection-molded base of a contact base block according to another embodiment of the present invention, respectively.
Figure 13D:
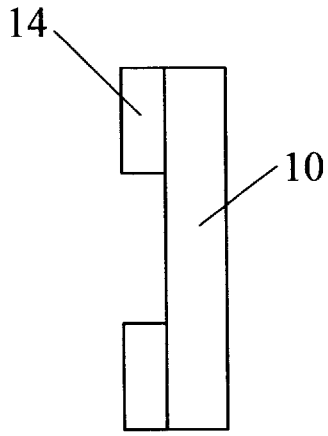
Figure 13B:
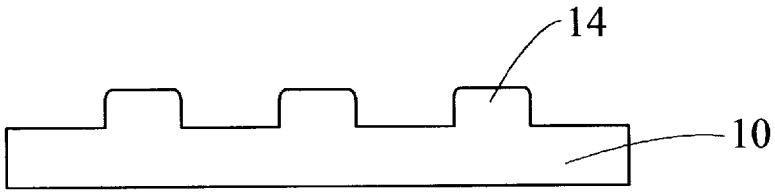
Figure 13C:
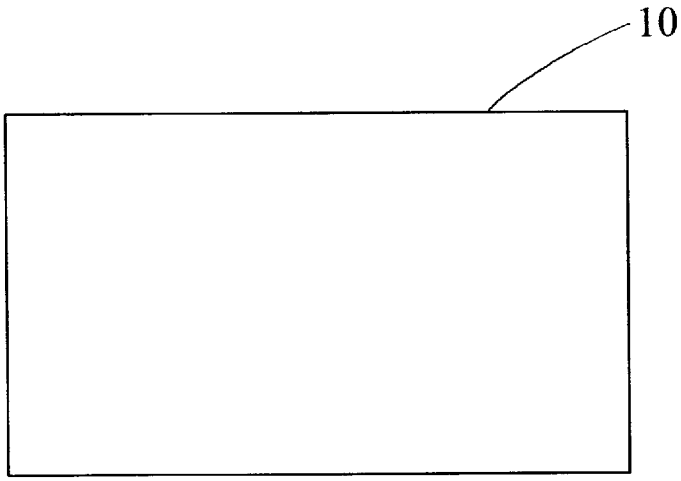

As shown in FIG. 2, the coil block 4 is an injection-molded article of an electrical insulating material, which houses the electromagnet 3 including a coil, iron core, and a permanent magnet and the armature 52. When the coil block 4 is mounted on the contact sub block 2, as shown in FIGS. 9A and 9B, pivot shafts 53 of the armature 52 are supported by the bearing portions 35 of the subbase 30 such that the armature can be driven in the seesaw fashion by energizing the electromagnet 3.

The high frequency relay having the above-explained structure operates as follows. The electromagnet 3 is energized by applying a required voltage thereto, so that the armature 52 is driven in the seesaw fashion. For example, when the armature is driven, as shown in FIG. 1, the motion of the armature 52 is transferred to one of the contact members 21 through the first spring member 42, so that the contact member is moved against the spring bias of the second spring member 45 to obtain a connection between the fixed contacts 70(*b*), 70(*c*) by the movable contact 22(*b*). On the other hand, since the motion of the armature 52 is not transferred to the other one of the contact members 21, the contact member receives the spring bias of the second spring member 45, so that the movable contact 22(*a*) is spaced from the fixed contacts 70(*a*), 70(*b*), and comes into contact with the fourth metal film 92 of the subbase 30. From the above, the high frequency signals flow between the fixed contacts 70(*b*), 70(*c*) with the help of the movable contact 22(*b*).

A modification of the contact base block of the above embodiment is shown in FIGS. 10A to 10C, which is substantially the same as that of above embodiment except for the following structural features. That is, this contact base block 1 is characterized by comprising a shield wall 25 integrally formed with the base 10 to separate a first contact set of the fixed contacts (upper 3 fixed contacts 70 of FIG. 10A) and the contact members 21 used to switch a high frequency signal from a second contact set of the fixed contacts (lower 3 fixed contacts 70 of FIG. 10A) and the contact members 21 used to switch another high frequency signal. The formation of the shield wall 25 is effective to improve signal isolation performance between the first and second contact sets and prevent the occurrence of signal leakage. Alternatively, the shield wall 25 may be integrally formed with the subbase 30, or completed by a first shield wall integrally formed with the base and a second shield wall integrally formed with the subbase.

In the above embodiment, the conductive layer 68 is formed on the inner surface of the respective through holes 16 and then the sealing material 62 is charged into the through holes. As shown in FIGS. 11A and 11B, a metal pin 65 may be inserted into the through hole 16 to make the electrical connection between one of the fixed contacts, i.e., the first metal films 70, and the corresponding second metal film 80. In this case, it is preferred to determine the length of the metal pin 65 such that a top end of the metal pin inserted into the through hole slightly projects on the first metal film 70, as shown in FIG. 11B. Since the movable contact 22 comes into contact with the top end of the metal pin 65, it is possible to provide an extended life of the fixed contacts 70. The metal pin 65 may be press-inserted into the through hole 16 or fixed to the through hole by use of an adhesive.

As the sealing material charged into the through hole 16, 17 of the base 10, for example, it is preferred to use an epoxy resin. In this case, since shrinkage of the epoxy resin is caused in the through hole by heating and drying the charged epoxy resin, it is possible to stably perform the sealing operation without allowing the resin to overflow from the through hole. In place of the charge of the sealing material, a synthetic-resin pin may be inserted into the through hole and then melted therein.

In place of the formation of the conductive layer in the through hole 16 and the charge of the sealing material 62 into the through hole, a conductive paste material such as silver, nickel and solder pastes may be charged into the through hole 16. In this case, since electric current flows between the first and second metal films 70, 80 through the charged conductive paste material having an increased cross section, it is possible to reduce the electrical resistance and provide an improved shield effect.

In case of charging the sealing material or the conductive paste material, it is preferred that the through hole is a countersunk hole 19, as shown in FIGS. 12A and 12B. That is, FIG. 12A shows a state of the instant following of charging the sealing material 62 into the countersunk hole 19, and FIG. 12B shows the sealing material 62 cured in the countersunk hole. Since a diameter of the through hole in the vicinity of the first metal film 70 is greater than the diameter of the interior of the through hole, it is possible to effectively prevent the overflow of the sealing material 62 or the paste material from the through hole.

Next, a contact base block and a contact sub block of the high frequency relay according to another embodiment of the present invention are explained referring to the attached drawings.

Figure 14A:
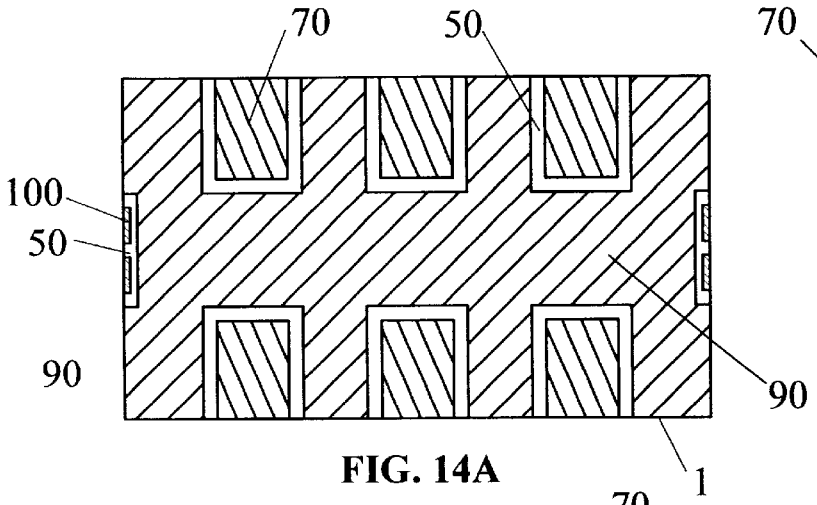
FIGS. 14A to 14D are a front view, side view, rear view and a side view of the contact base block, respectively.
Figure 14D:
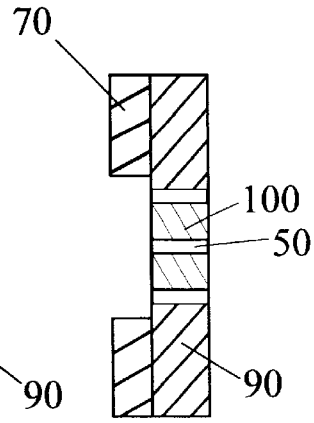
Figure 14B:
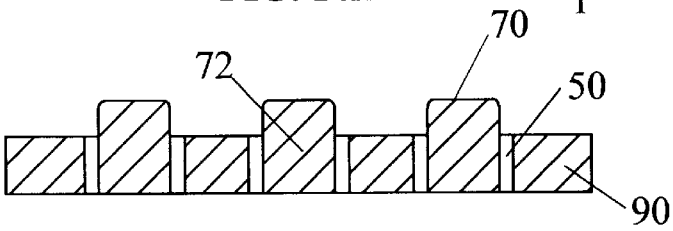
Figure 14C:
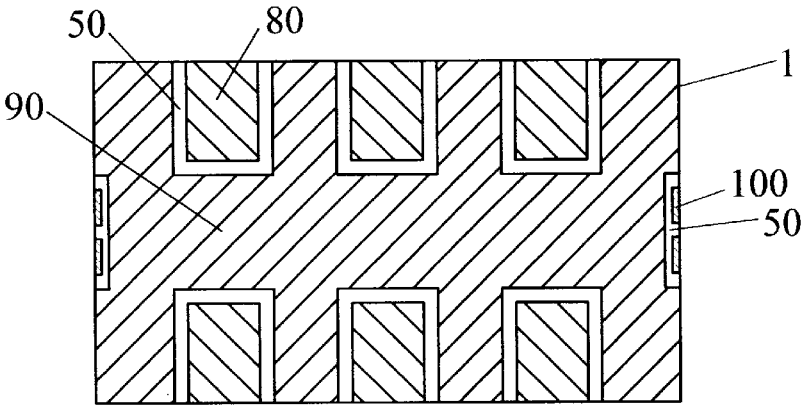
Figure 15:
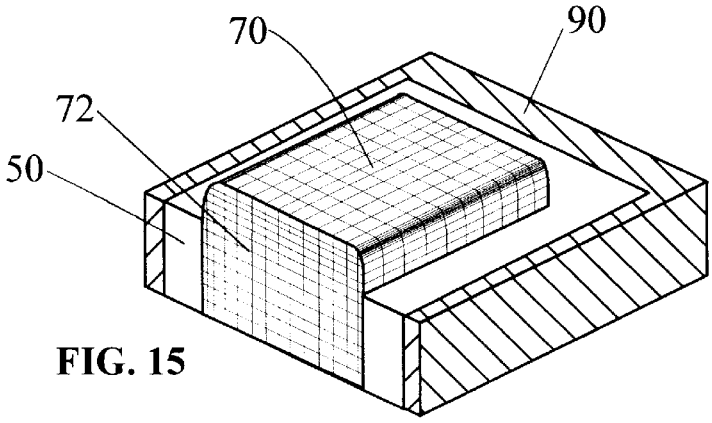
FIG. 15 is a partially perspective view of the contact base block.
Figure 16A:
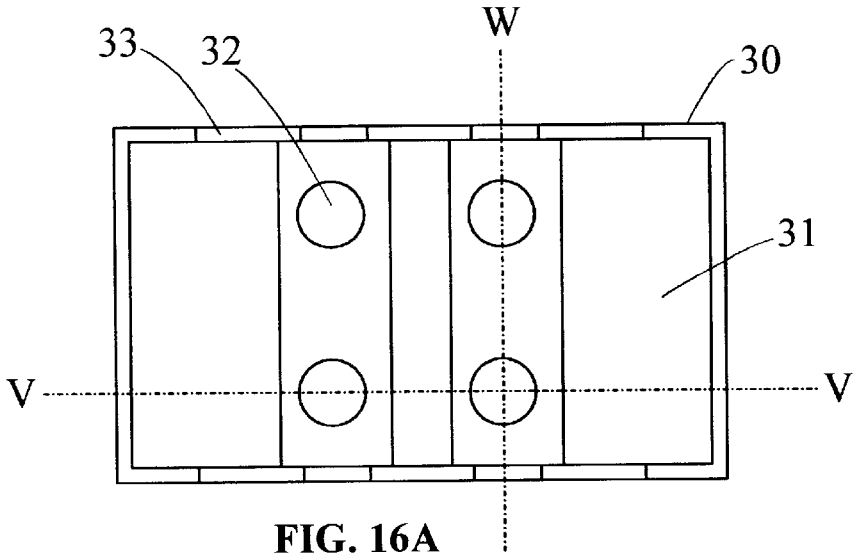
FIGS. 16A to 16D are a front view, cross-sectional view taken along the line V, rear view and a cross-sectional view taken along the line W of an injection-molded subbase of a contact sub block according to another embodiment of the present invention, respectively.
Figure 16D:
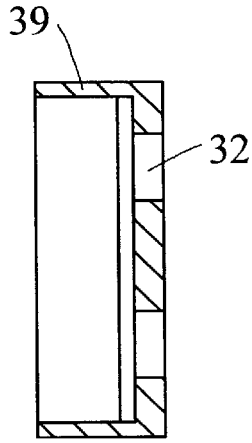
Figure 16B:
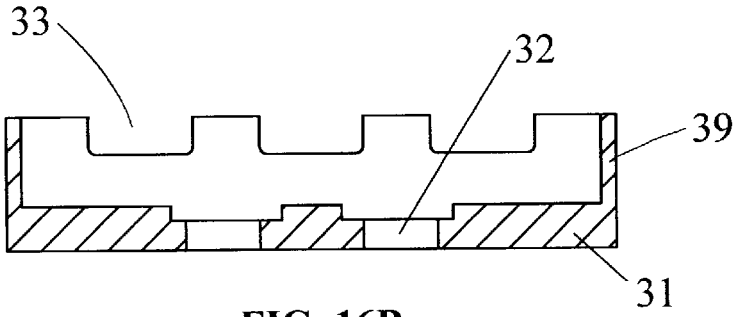
Figure 16C:
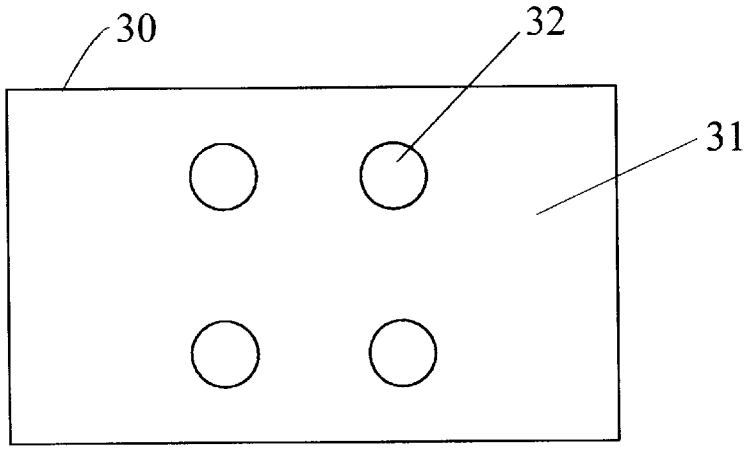
Figure 17A:
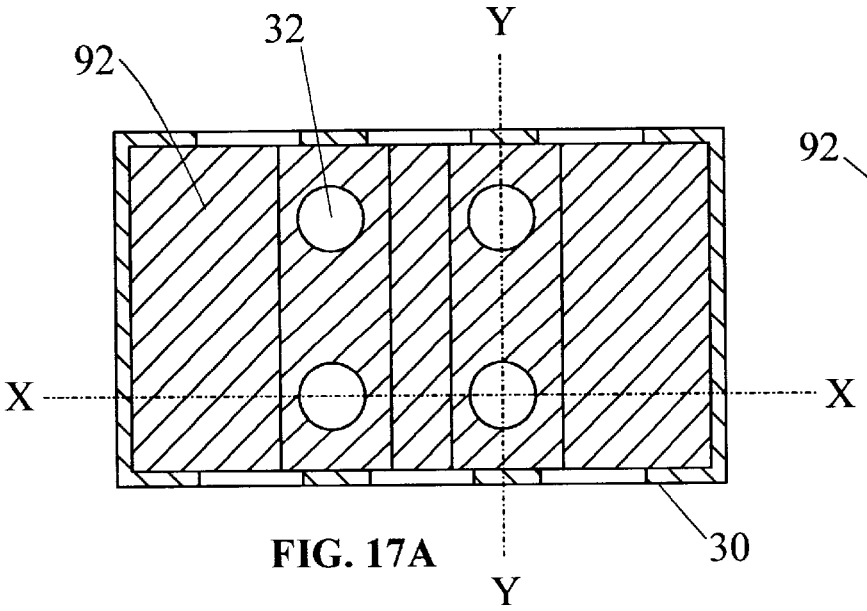
FIGS. 17A to 17D are a front view, cross-sectional view taken along the line X, rear view and a cross-sectional view taken along the line Y of the contact sub block, respectively.
Figure 17D:
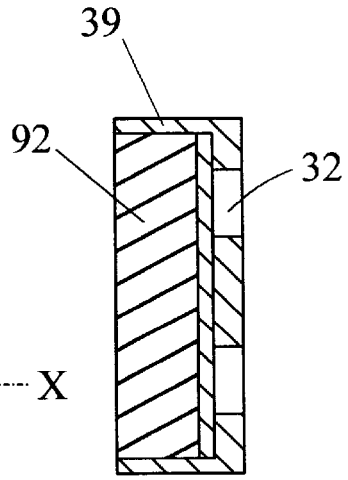
Figure 17B:
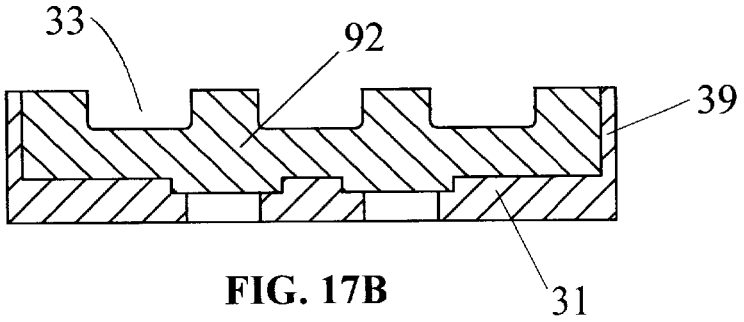
Figure 17C:
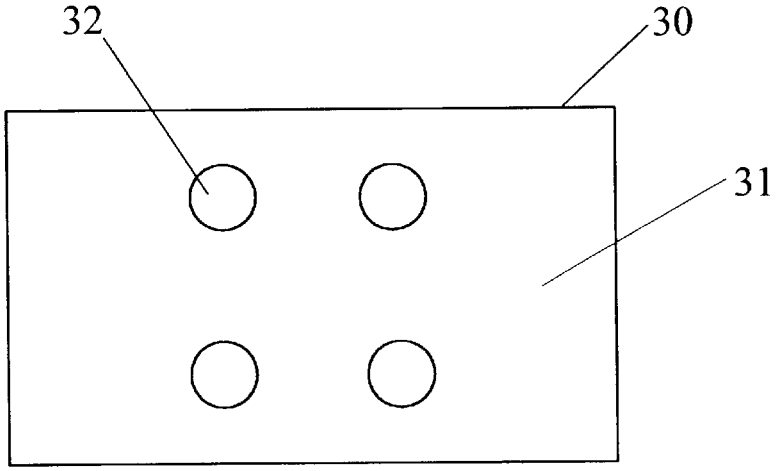

FIGS. 13A to 13D show a base 10 of the contact base block 1 that is an injection-molded article of an electrical insulating material. The base 10 is of a rectangular plate shape having rectangular projections 14 on its front surface. First, second and third metal films 70, 80, 90 are formed on the base 10, as shown in FIGS. 14A to 14D. That is, the first metal films 70 are formed on the projections 14. Each of the second metal films 80 is formed at a position opposed to the corresponding one of the first metal films 70 on a rear surface of the base. The first metal film 70 is electrically connected to the corresponding second metal film 80 by a sixth metal film 72 formed on side surface of the base 10, as shown in FIG. 14B. The third metal film 90 is formed to extend from the front surface to the rear surface through the side surfaces of the base 10. The first, second and sixth metal films 70, 80, 72 are isolated from the third metal film 90 by an isolation area 50 having no metal film. Each of the rectangular projections 14 has a pair of rounded sides on its top to prevent the occurrence of arc discharge between the fixed contacts 70 and the movable contact 22, as shown in FIG. 15. The numeral 100 designates coil electrodes for supplying electric power to the electromagnet 3 of the high frequency relay, which are electrically isolated from the third metal film 90 by the isolation area 50.

FIGS. 16A to 16D show a subbase 30 of the contact sub block 2 that is an injection-molded article of an electrical insulating material. The subbase 30 is of a rectangular case shape composed of a bottom wall 31, side walls 39 jutting from the periphery of the bottom wall, and a top opening. The side walls 39 have concaves 33, to which the rectangular projections 14 of the base 10 are fitted when the contact sub block 2 is mounted on the contact base block 1. Therefore, these projections 14 and the concaves 33 also function as guide means for readily and accurately mounting the contact sub block 2 on the contact base block 1.

As shown in FIGS. 17A to 17D, a fourth metal film 92 is formed on inner surfaces of the rectangular case of the subbase 30. The third metal film 90 on the base 10 makes an electromagnetic shield space for preventing a leakage of high frequency signal in cooperation with the fourth metal film 92 when the contact sub block 2 is mounted on the contact base block 1. The numeral 32 designates circular through-holes, to each of which the assembly of the contact member 21 having the movable contact 22 and the first spring member 45 is attached.

Next, an embodiment of a method of manufacturing the contact base block 1 of the high frequency relay of the present invention is explained referring to FIGS. 18A to 18F.

After the base 10 is injection-molded with the electrical insulating resin material (FIG. 18A), a chromium film 110 is deposited on the base 10 by spattering, as shown in FIG. 18B. Next, a copper film 120 is deposited on the chromium film 110 by spattering in the atmosphere of argon, as shown in FIG. 18C, to obtain an undercoat. The chromium film 110 is effective to improve adhesion between the base 10 and the copper film 120. Then, as shown in FIG. 18D, a part of the undercoat is removed from the base 10 by irradiating a laser beam 200 to the undercoat along a required pattern to obtain a patterned undercoat. Next, as shown in FIG. 18E, an intermediate layer 130 of nickel is formed the patterned undercoat by electroplating, and then an outer layer 140 of gold is formed on the intermediate layer 130 by electroplating, as shown in FIG. 18F. According to the above method, the first, second and third metal films 70, 80, 90 can be formed at a time on the base 10.

Figure 20:
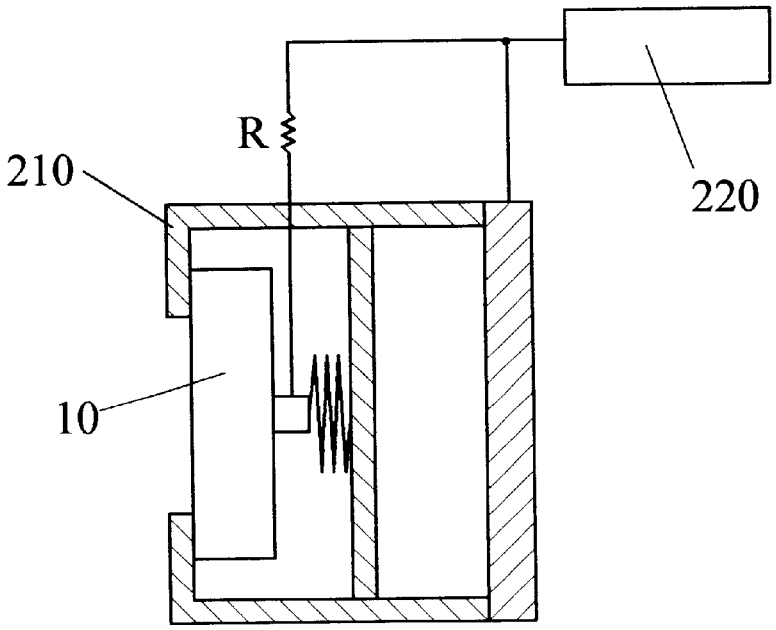
FIG. 20 is a wiring diagram for the electroplating.

In case of controlling the plating thickness of the gold layer such that the thickness of the gold layer of the first metal film 70 is thicker than that of the third metal film 90, for example, it is preferred to perform the electroplating by use of electrode members 210 shown in FIGS. 19 and 20. That is, the nickel layers of the first metal films 70 are connected to a power source 220 through electrode members 210. On the other hand, the nickel film of the third metal film 90 is connected to the same power source 220 through a resistance R. The electrode members 210 are electrically isolated from the third metal film 90. Since a smaller amount of electric current is supplied to the nickel film of the third metal film 90 due to the presence of the resistance R, it is possible to readily obtain the third metal film 90 having a reduced thickness of the gold layer.

Figure 21:
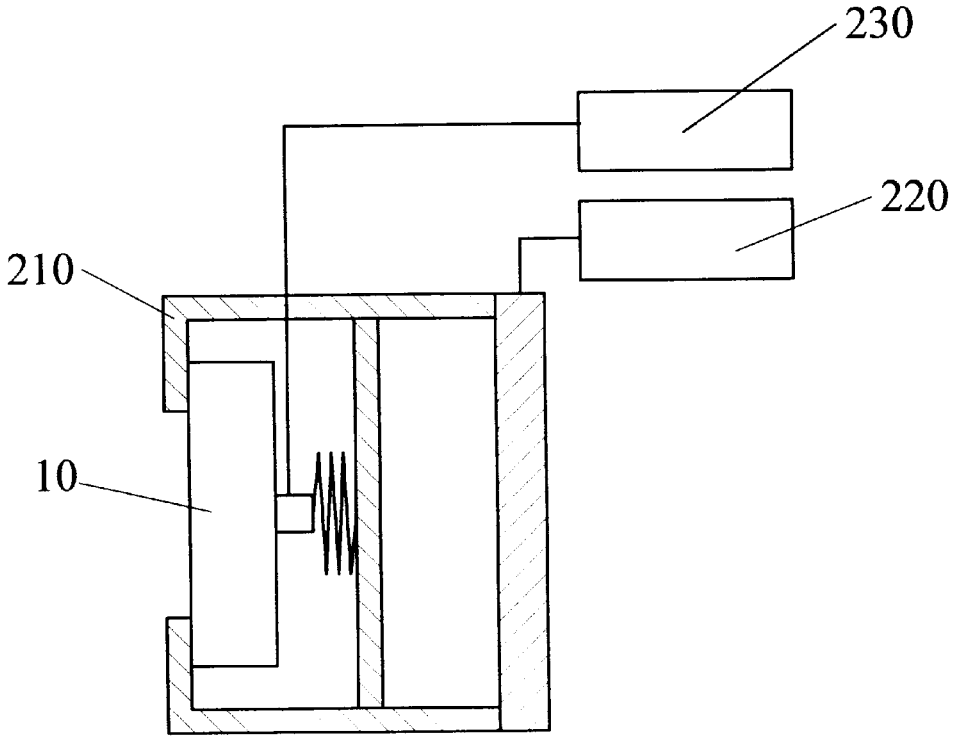
FIG. 21 is another wiring diagram for the electroplating.

In addition, it is possible to form the gold layers on only the nickel layers of the first metal films 70 by electroplating. That is, as shown in FIG. 21, the nickel layers of the first metal films 70 are connected to a first power source 220 through the electrode members 210. On the other hand, the nickel layer of the third metal film 90 is connected to a second power source 230. In case of the electroplating of gold, electric current is supplied to only the nickel films of the first metal films 70 from the first power source 220. On the other hand, when the electroplating of a metal other than gold is required for the third metal film 90, electric current is supplied to only the nickel film of the third metal film from the second power source 230.

A further preferred embodiment of the method of manufacturing the contact base block of the high frequency relay of the present invention is explained referring to FIGS. 22A to 22K.

Figures 22A, 22B, 22C, 22D, 22E, 22F, 22G, 22H, 22I, 22J, 22K:
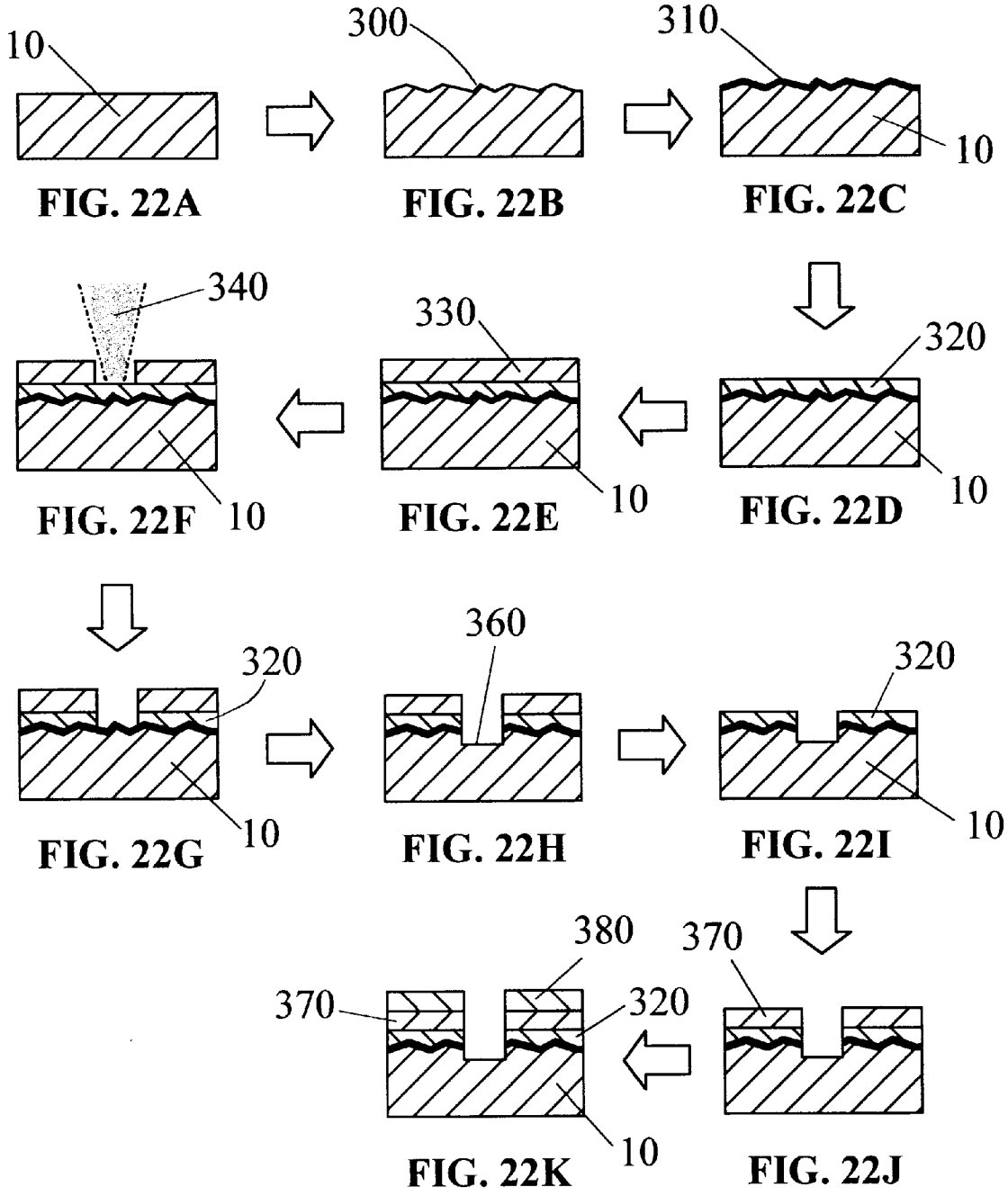
FIGS. 22A to 22K are schematic diagrams illustrating a method of manufacturing a contact base block of the high frequency relay according to a further preferred embodiment of the present invention.

After the base 10 is injection-molded with the electrical insulating resin material (FIG. 22A), a roughing treatment 300 is performed on a surface of the base 10 with use of sodium hydroxide, as shown in FIG. 22B. Next, a catalyst 310 is applied on the roughed surface 300, as shown in FIG. 22C. Then, an undercoat of copper 320 is formed on the roughed surface with the catalyst by electroless plating, as shown in FIG. 22D. After a photoresist film 330 is formed on the undercoat 320, as shown in FIG. 22E, a laser beam 340 is radiated to the photoresist film 330 along a required pattern, as shown in FIG. 22F. By developing this, a patterned resist film is obtained on the undercoat.

The exposed undercoat is removed from the base 10 by chemical etching (FIG. 22G). Since a required region of the undercoat 320 is removed by use of the patterned resist film 330 by the laser beam 340, it is possible to readily obtain a precision pattern of the undercoat. At this time, since the catalyst remains on the exposed surface of the base 10, it is preferred to remove the insulating material in the vicinity of the exposed surface of the base together with the remaining catalyst by use of sodium hydroxide, as shown in FIG. 22H. Thus, a fresh surface 360 of the base 10 is exposed along the required pattern. Next, the patterned resist is removed to obtain a patterned undercoat 320 of copper, as shown in FIG. 221. Then an intermediate layer 370 of nickel is formed on the patterned undercoat 320 by electroplating, and an outer layer 380 of gold is formed on the intermediate layer 370, as shown in FIGS. 22J and 22K. If necessary, the step of FIG. 22H may be omitted.

From understood from the above embodiments, the present invention provides the high frequency relay with a refined structure having the capability of enhancing the assembly task of the relay and effectively preventing the leakage of high frequency signals.

What is claimed is:

1. A high frequency relay comprising a contact base block having at least one pair of fixed contacts, at least one contact member with a movable contact, and an electromagnet for moving said contact member to open and close said pair of fixed contacts by said movable contact, wherein said contact base block comprises:

a base having at least one pair of projections on its top surface, which is an injection-molded article of an electrical insulating material;

first metal films formed as said fixed contacts on top surfaces of said projections;

second metal films formed as connection terminals for outside devices on said base, each of which corresponds to one of said first metal films;

connecting means for making an electrical connection between each of said first metal films and the corresponding second metal film; and a third metal film at least formed on the top surface of said base to provide electrical isolation from said first and second metal films, which works as electromagnetic shield means.

2. The high frequency relay as set forth in claim 1, wherein said third metal film extends from the top surface to a bottom surface through side faces of said base, which works as ground means as well as said electromagnetic shield means.

3. The high frequency relay as set forth in claim 2, wherein said base has at least one through hole extending from the top surface to the bottom surface of said base, in which an electrically conductive material is coated to make an electrical connection between parts of said third metal film on the top and bottom surfaces of said base in the shortest distance.

4. The high frequency relay as set forth in claim 1, wherein each of said projections has a first projection jutting from the top surface of said base and a second projection jutting from said first projection, and wherein each of said first metal films is formed on a top of said second projection and said third metal film is formed on side faces of said first projections.

5. The high frequency relay as set forth in claim 1, wherein each of said projections has a rounded top, on which said first metal film is formed.

6. The high frequency relay as set forth in claim 1, each of said first, second and third metal films is composed of a copper layer as an undercoat, nickel layer as an intermediate layer, and a gold layer as an outer layer, and wherein a thickness of the outer layer of said first metal films is greater than that of said second and third metal films.

7. The high frequency relay as set forth in claim 1, comprising fifth metal films formed as coil electrodes for supplying electric power to said electromagnet on said base so as to provide electrical isolation from said first, second and third metal films.

8. The high frequency relay as set forth in claim 1, comprising a contact sub block for movably supporting said contact member, which comprises:

a subbase that is an injection-molded article of an electrical insulating material; and a fourth metal film formed on a surface of said subbase in a face to face relation with the top surface of said base when said contact sub block is mounted on said contact base block, so that said pair of fixed contacts are opened and closed by said movable contact in an electromagnetic shield space surrounded by said third and fourth metal films.

9. The high frequency relay as set forth in claim 8, wherein said movable contact comes into contact with a required region of said fourth metal film when said pair of fixed contacts are opened by said movable contact, and wherein the required region of said fourth metal film is composed of a copper layer as an undercoat, nickel layer as an intermediate layer and a gold layer as an outer layer, and the balance of said fourth metal film is composed of a copper layer as the undercoat and a nickel layer as the outer layer.

10. The high frequency relay as set forth in claim 8, comprising a first contact set of a first pair of fixed contacts and a first contact member used to switch a high frequency signal and a second contact set of a second pair of fixed contacts and a second contact member used to switch another high frequency signal, and wherein a shield wall for isolating said first contact set from said second contact set is integrally-molded with at least one of said base and said subbase.

11. The high frequency relay as set forth in claim 8, comprising a coil block for housing said electromagnet, and wherein said subbase has coil block supporting means for supporting said coil block, which is integrally molded with said subbase.

12. The high frequency relay as set forth in claim 11, wherein said coil block comprises an armature disposed between said contact member and said electromagnet and driven by energizing said electromagnet, and wherein a motion of said armature is transferred to said contact member through a first spring member held by spring holding means integrally molded with said subbase.

13. The high frequency relay as set forth in claim 12, said coil block supporting means and said spring holding means are provided to a surface opposed to the surface having said fourth metal film of said subbase, and said contact member is attached to a through hole formed in said subbase with a second spring member such that said contact member receives a spring bias of said second spring member in a direction of spacing said movable contact from said fixed contacts, and wherein said contact member can be moved against the spring bias of said second spring member by said first spring member pushed by said armature to close said fixed contacts by said movable contact.

14. The high frequency relay as set forth in claim 1, wherein each of said second metal films is formed on a bottom surface of said base at a position opposed to the corresponding one of said first metal films.

15. The high frequency relay as set forth in claim 14, wherein said connecting means is metal pins, each of which is inserted into said base to electrically connect one of said first metal films with the corresponding second metal film in the shortest distance.

16. The high frequency relay as set forth in claim 14, wherein said connecting means is through holes each having a conductive layer on its inner surface, each of which is formed in said base to electrically connect one of said first metal films with the corresponding second metal film in the shortest distance.

17. The high frequency relay as set forth in claim 14, wherein said connecting means is through holes, each of which is filled with an electrically conductive material and formed in said base to electrically connect one of said first metal films with the corresponding second metal film in the shortest distance.

18. The high frequency relay as set forth in claim 14, wherein each of said second metal films extends from the bottom surface to a side surface of said base, and said second metal films on the side surface are used to electrically connect with the outside devices.

19. A high frequency relay comprising a contact base block having at least one pair of fixed contacts, at least one contact member with a movable contact, a contact sub block for movably supporting said contact member, and an electromagnet for moving said contact member to open and close said pair of fixed contacts by said movable contact, wherein said contact base block comprises:

a base that is an injection-molded article of an electrical insulating material;

first metal films formed as said fixed contacts on a top surface of said base;

second metal films formed as connection terminals for outside devices on said base, each of which corresponds to one of said first metal films;

connecting means for making an electrical connection between each of said first metal films and the corresponding second metal film; and a third metal film at least formed on the top surface of said base to provide electrical isolation from said first and second metal films, which works as electromagnetic shield means, and wherein said contact sub block comprises:

a subbase that is an injection-molded article of an electrical insulating material; and a fourth metal film formed on a surface of said subbase in a face to face relation with the top surface of said base when said contact sub block is mounted on said contact base block, so that said pair of fixed contacts are opened and closed by said movable contact in an electromagnetic shield space surrounded by said third and fourth metal films.

* * * * *